US008207103B2

(12) United States Patent
Dabela et al.

(10) Patent No.: US 8,207,103 B2
(45) **Date of Patent: *Jun. 26, 2012**

(54) PRINTING PRESS CLEANING COMPOSITIONS

(75) Inventors: Raymond Dabela, Chino Hills, CA (US); Jeffrey L. Rogers, Long Beach, CA (US)

(73) Assignee: Explorer Pressroom Solutions, Inc., Santa Fe Springs, CA (US)

( * ) Notice: Subject to any disclaimer, the term of this patent is extended or adjusted under 35 U.S.C. 154(b) by 633 days.

This patent is subject to a terminal disclaimer.

(21) Appl. No.: 11/747,812

(22) Filed: May 11, 2007

(65) Prior Publication Data

US 2008/0280801 A1 Nov. 13, 2008

(51) Int. Cl.
*C11D 3/30* (2006.01)
*C23D 17/00* (2006.01)

(52) U.S. Cl. ..... 510/170; 510/108; 510/109; 510/171; 510/174; 510/400; 510/405; 510/461

(58) Field of Classification Search ..... 8/137–142; 510/407–417, 108, 109, 170, 171, 174, 400, 510/405, 461; 252/104–171
See application file for complete search history.

(56) References Cited

U.S. PATENT DOCUMENTS

| | | | | |
|---|---|---|---|---|
| 5,096,501 | A | 3/1992 | Dishart et al. | |
| 5,602,089 | A | 2/1997 | Pennaz | |
| 5,691,288 | A * | 11/1997 | Dhillon | 510/171 |
| 6,045,784 | A | 4/2000 | Ruebusch et al. | |
| 6,391,837 | B1 * | 5/2002 | Coleman | 510/238 |
| 6,491,730 | B1 | 12/2002 | Cauble, Jr. et al. | |
| 6,929,702 | B1 | 8/2005 | Motsenbocker | |
| 2003/0121106 | A1 | 7/2003 | Bargaje et al. | |
| 2004/0121927 | A1 | 6/2004 | McDonald | |
| 2005/0277718 | A1 * | 12/2005 | Johnson | 524/261 |
| 2007/0135325 | A1 * | 6/2007 | Hawes et al. | 510/407 |

FOREIGN PATENT DOCUMENTS

EP 0174711 3/1986

OTHER PUBLICATIONS

Material Safety Data Sheet for Marathon 142 Solvent, MSDS ID No. 0251MAR019, dated Sep. 12, 2005.
International Search Report and Written Opinion issued Aug. 4, 2008 in PCT/US2008/063282.
Material Safety Data Sheet for Dow Corning(TM) 345 Fluid. Dated Jun. 2, 2008.
Material Safety Data Sheet for Dow Corning(TM) 244 Fluid. Dated Jul. 13, 2007.
Pilot Chemical Company, Product Data Sheet for CALIMULSE(TM) PRS. Undated. Obtained from the company website on Mar. 5, 2010.
Material Safety Data Sheet for methyl oleate. Dated Oct. 3, 2005.
Material Safety Data Sheet for parachlorobenzotrifluride (PCBTF). Dated Jan. 5, 2005.
Material Safety Data Sheet for limonene. Dated Nov. 6, 2008.
Material Safety Data Sheet for sorbitan monooleate Dated Nov. 6, 2008.
Material Safety Data Sheet for HFE-7200 3M(TM) Novec (TM) Engineered Fluid. Dated Sep. 19, 2003.

* cited by examiner

*Primary Examiner* — Lorna M Douyon
*Assistant Examiner* — Tri V Nguyen
(74) *Attorney, Agent, or Firm* — Sam K. Tahmassebi; TechLaw LLP

(57) ABSTRACT

Disclose herein is a composition comprising a hydrocarbon solvent; an aromatic solvent; a methylated siloxane; and a surfactant. Also disclosed is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

12 Claims, No Drawings

PRINTING PRESS CLEANING COMPOSITIONS

FIELD OF THE INVENTION

The present invention is in the field of cleaning solutions and mixtures, and particularly in the field of cleaning solutions and mixtures used in the printing industry.

BACKGROUND

Offset printing is a widely used printing technique where the inked image is transferred (or "offset") from a plate to a rubber blanket, then to the printing surface, e.g., paper. When used in combination with the lithographic process, which is based on the repulsion of oil and water, the offset technique employs a flat (planographic) image carrier on which the image to be printed obtains ink from ink rollers, while the non-printing area attracts a film of water, keeping the non-printing areas ink-free.

During the operation of the printing machine, ink regularly contaminates the non-printing areas, causing smears or smudges to appear on the printed surface, or in general interfere with the operation of the printing machine. In addition, pulp and dust from the paper used as the printing surface rises from the paper as the paper travels through the printing machine. This dust settles on the various parts of the printing machine, including the rollers, plates, and blankets, and contaminates these parts and interferes with the printing mechanism. In some applications, before they are fed to the printer, various pieces of paper are stacked on top of each other with a layer of spray powder, such as corn starch, separating them. The spray powder ensures that the pieces of paper do not stick together and are fed individually into the printing machine. Over time, the spray powder accumulates on the rollers, plates, and blankets and interferes with the printing mechanism.

Consequently, printing machines are cleaned regularly by applying a cleaning solution to the rollers, plates, and blankets to remove the ink and the grime from these parts. Traditionally, cleaning solutions have contained volatile organic compounds (VOCs). It is well-known that VOCs are not environmentally friendly. They are potential carcinogens, contribute to the depletion of the ozone layer, and may contribute to the green house effect that is responsible for global warming. As the result, governments have enacted restrictions on the use of VOCs in various industries, including the printing industry.

To comply with government regulations, various cleaning solutions having low VOC content have been marketed. These cleaning solutions are, for the most part, oil based. Oils have relatively low vapor pressures and are generally not considered to be volatile. However, oils are not satisfactory for use as printing machine cleaning agents. The oils in the cleaning solutions have a tendency to splatter. Once the oil has been used it accumulates at the bottom of the printing machine and then splatters on various parts, causing additional contamination. In addition, oils are difficult to remove and dispose.

Therefore, there is a need in the industry for a low VOC solvent that is compliant with governmental regulations, is economical to use, and cleans the printing machines efficiently and effectively.

SUMMARY OF THE INVENTION

Disclose herein is a composition comprising a hydrocarbon solvent; an aromatic solvent; a methylated siloxane; and a surfactant. Also disclosed is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

DETAILED DESCRIPTION OF THE ILLUSTRATED EMBODIMENTS

Thus, in one aspect, disclosed herein is a composition comprising a hydrocarbon solvent, an aromatic solvent, a methylated siloxane, and a surfactant.

In some embodiments, the hydrocarbon solvent comprises a linear or branched alkyl chain, a cycloalkyl, a double bond, a triple bond, or a combination thereof. In other embodiments, the hydrocarbon solvent is a natural product. In certain embodiments, the hydrocarbon solvent comprises a $C_5$-$C_{30}$ hydrocarbon. As used herein, "$C_m$ to $C_n$" in which "m" and "n" are integers refers to the number of carbon atoms in an alkyl, alkenyl, alkynyl and the rings of cycloalkyl and cycloalkenyl group. That is, the alkyl, alkenyl or alkynyl can contain from "m" to "n", inclusive, carbon atoms.

In some embodiments, the hydrocarbon solvent is a mixture of at least two $C_5$-$C_{30}$ hydrocarbons. Thus, as used herein, the term "hydrocarbon solvent" refers not only to a solvent containing a single chemical species, but also to a solvent containing a mixture of two or more chemical species, each chemical species being a hydrocarbon.

In some embodiments, the hydrocarbon solvent is selected from the group consisting of limonene, lacolene, and Solvent 142. Solvent 142 is a low odor petroleum distillate blend that is used as an industrial cleaning solvent, and is suitable for use where low flash point mixtures cannot be tolerated.

In some embodiments, the aromatic solvent comprises an optionally substituted phenyl ring. Unless otherwise indicated, when a compound, or a portion thereof, is deemed to be "optionally substituted," it is meant that the substituted compound, or portion thereof, is a group that may be substituted with one or more group(s) individually and independently selected from alkyl, alkenyl, alkynyl, cycloalkyl, aryl, heteroaryl, heteroalicyclic, hydroxyl, alkoxy, aryloxy, mercapto, alkylthio, arylthio, cyano, halo, carbonyl, thiocarbonyl, O-carbamyl, N-carbamyl, O-thiocarbamyl, N-thiocarbamyl, C-amido, N-amido, S-sulfonamido, N-sulfonamido, C-carboxy, O-carboxy, isocyanato, thiocyanato, isothiocyanato, nitro, silyl, trihalomethanesulfonyl, and amino, including mono- and di-substituted amino groups, and the protected derivatives thereof. The protecting groups that may form the protective derivatives of the above substituents are known to those of skill in the art and may be found in references such as Greene and Wuts, Protective Groups in Organic Synthesis, 3rd Ed., John Wiley & Sons, New York, N.Y., 1999, which is incorporated herein in its entirety.

In some embodiments, the aromatic solvent is a mixture of at least two compounds, each of which comprises an optionally substituted phenyl ring. Thus, as used herein, the term "aromatic solvent" refers not only to a solvent containing a single chemical species, but also to a solvent containing a mixture of two or more chemical species, each chemical species being an aromatic compound.

In some embodiments, the aromatic solvent comprises an optionally substituted halobenzene. A "halobenzene" is a benzene or phenyl group that is substituted with one or more halogens, such as fluoro, chloro, bromo, or iodo. In certain embodiments, the aromatic solvent comprises an optionally substituted perhaloalkylbenzene. A "perhaloalkylbenzene" is a benzene or phenyl group that is substituted with one or more alkyl groups, all of whose hydrogen atoms have been replaced by a halogen. Examples of perhaloalkyl groups include, but are not limited to, trifluoromethyl, trichloromethyl, tribromomethyl, pentafluoroethyl, pentachloroethyl, and the like. In some embodiments, the aromatic solvent is 1-chloro-4-(trifluoromethyl)benzene.

In some embodiments, the methylated siloxane is a cyclic, branched, or linear methylated siloxane. A siloxane comprises several terminal —OH groups. In a "methylated siloxane" the hydrogen atom of at least one of the —OH groups is replaced with a methyl group. In some embodiments, the methylated siloxane comprises between 4-20 methyl groups.

In some embodiments, the methylated siloxane is a mixture of at least two methylated siloxanes. Thus, as used herein, the term "methylated siloxane" refers not only to a solvent containing a single chemical species, but also to a solvent containing a mixture of two or more chemical species, each chemical species being a methylated siloxane.

In some embodiments, the methylated siloxane is selected from the group consisting of octamethylcyclotetrasiloxane, decamethylcyclopentasiloxane (SF 1202), dodecamethylcyclohexasiloxane, and a combination thereof.

In some embodiments, the surfactant can also act as an emulsifier. Typically, surfactants are long chain hydrocarbons, which may comprise one or more points of unsaturation, i.e., double (both cis and trans) or triple bonds. In some embodiments, the surfactant comprises a fatty acid or a salt or ester thereof.

Fatty acids are long chain hydrocarbons, typically containing a carboxyl group at one terminus, which are normally obtained from hydrolyzing fats or oils. Some synthetic long chain hydrocarbons can also be called fatty acids, even though they are not obtained from naturally occurring fats or oils. In the context of the present disclosure, the term "fatty acid" includes any long chain hydrocarbon, even if the chain does not contain a carboxyl group. By "long chain" it is meant that the hydrocarbon chain comprises 5-50 carbon atoms (e.g., a $C_5$-$C_{50}$ chain). In some embodiments, the fatty acid is selected from the group consisting of caproic acid, caprylic acid, capric acid, lauric acid, myristic acid, palmitic acid, stearic acid, arachidic acid, behenic acid, myristoleic acid, palmitoleic acid, oleic acid, linoleic acid, alpha-linolenic acid, arachidonic acid, eicosapentaenoic acid, erucic acid, and docosahexaenoic acid. In some embodiments, the fatty acid is oleic acid.

In some embodiments, the surfactant is a salt or ester of oleic acid, which can optionally be selected from, for example, sorbitan monooleate or methyl oleate.

In some embodiments, the surfactant is a salt of an alkyl aromatic sulfonic acid. This particular surfactant can be an amine, alkali metal, or ammonium salt of an alkyl aromatic sulfonic acid as an anionic emulsifier. The alkylaromatic hydrophobe solubilizes well in oily mixtures. This surfactant emulsifier produces little foam, compared to conventional anionic surfactants. The surfactant may be an amine, alkali metal, or ammonium salt of an alkyl benzene or alkyl naphthalene sulfonic acid. Examples include, but are not limited to, an isopropylamine salt of linear dodecylbenzene sulfonic acid, an isopropylamine salt of branched dodecylbenzene sulfonic acid, a diethanolamine salt of linear or branched dodecylbenzene sulfonic acid, and the like, as well as mixtures thereof. In some embodiments, the alkyl aromatic sulfonic acid is isopropylamine linear dodecylbenzene sulfonate (CALIMULSE PRS).

In some embodiments, the surfactant is a mixture of at least two surfactants. Thus, as used herein, the term "surfactant" refers not only to a solvent containing a single chemical species, but also to a solvent containing a mixture of two or more chemical species, each chemical species acting as a surfactant.

In some embodiments, the composition described herein comprises less than 50% by volume of a hydrocarbon solvent, less than 75% by volume of an aromatic solvent, less than 75% by volume of a methylated siloxane, and less than 75% by volume of a surfactant. In other embodiments, the composition described herein comprises less than 40% by volume of a hydrocarbon solvent, less than 50% by volume of an aromatic solvent, less than 50% by volume of a methylated siloxane, and less than 50% by volume of a surfactant. In yet other embodiments, the composition described herein comprises less than 35% by volume of a hydrocarbon solvent, less than 30% by volume of an aromatic solvent, less than 40% by volume of a methylated siloxane, and less than 20% by volume of a surfactant.

In some embodiments, the compositions described herein further comprise water. In some embodiments, the water is deionized water. In other embodiments, the water is distilled water.

The compositions disclosed herein have the advantage that they comprise low VOC components, i.e., the VOC content of the compositions is less than 200 g/L, and in some embodiments less than 150 g/L, in other embodiments 100 g/L, and in certain embodiments, less than 100 g/L.

In some embodiments, the compositions disclosed herein comprise less than 200 g/L of VOCs before water is added. After distilled water is added, the VOC content of the compositions is less than 100 g/L.

In another aspect, disclosed herein is a composition comprising an aromatic solvent, a methylated siloxane, and a surfactant, as these terms are described herein.

In another aspect, disclosed herein is a composition comprising a hydrocarbon solvent, a methylated siloxane, and a surfactant, as these terms are described herein.

In another aspect, disclosed herein is a composition comprising a hydrocarbon solvent, an aromatic solvent, and a surfactant, as these terms are described herein.

In another aspect, disclosed herein is a composition comprising a hydrocarbon solvent, an aromatic solvent, and a methylated siloxane, as these terms are described herein.

In some embodiments, the composition described herein is in the form of a solution, whereas in other embodiments, the composition is an emulsion.

Thus, in another aspect, described herein is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant, as these terms are described above. In some embodiments, the solution is mixed for about 4 hours. In other embodiments, the solution is mixed for about 8 hours. In yet other embodiments, the solution is mixed for about 12 hours. In further embodiments, the solution is mixed for about 24 hours. In other embodiments, the solution is mixed for longer than 24 hours.

In some embodiments, the solution is mixed at a rate of about 600 rpm. In other embodiments, the solution is mixed at a rate of less than 4000 rpm. In certain embodiments, the solution is mixed at a rate of between 600-3600 rpm.

The compositions described herein are best used for cleaning certain parts of printing machines, such as rollers, plates, or blankets. Thus, in another aspect, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant, as these terms are described above. In some embodiments, the cleaning mixture is a solution, whereas in other embodiments, the cleaning mixture is an emulsion.

When the operator of the printing machine decides that the parts of the printing machine, such as rollers, plates, or blankets, need to be cleaned, the operator can stop the ink and water flow to the rollers, and then pour the cleaning mixture, whether the solution or the emulsion, over the rollers. The cleaning solution moves through the printing machine and flows downwards, as ink or water would, and cleans the surface areas with which it comes in contact. In some embodiments, it is not necessary to stop the flow of paper through the printing machine during the cleaning cycle because the cleaning cycle takes a short amount of time. In other embodiments, the operator first stops the flow of paper through the printing machine and then, while the rollers and plates are still rotating, applies the cleaning mixture.

EXAMPLES

The following examples are non-limiting and presented only to illustrate some of the embodiments disclosed herein.

Example 1

Blanket and Roller Wash Mixtures

The following mixtures provide a low VOC (volatile organic compounds) roller and blanket wash mixture that is effective in a wide range of applications. The following mixtures can be used on, for example, sheet fed, automatic, web, or heat set printing machines. In the following, all volume fractions were determined at room temperature.

Mixture 1

| Ingredients | Volume Fraction |
|---|---|
| d-Limonene | 0.08 |
| Oxol 100 ® | 0.23 |
| Solvent 142 | 0.03 |
| Dow Corning 345 fluid | 0.38 |
| PRS | 0.007 |
| SMO | 0.025 |
| MOL | 0.12 |
| Deionized water | 0.128 |
| Net | 1 |

"Oxol 100®" is the trade name of Occidental Chemical Co. for parachlorobenzotriflouride (PCBTF). The IUPAC name for PCBTF is 1-chloro-4-(trifluoromethyl)benzene. "MOL" stands for methyl oleate. "SMO" stands for sorbitan monooleate. "PRS" stands for isopropylamine linear dodecylbenzene sulfonate (CALIMULSE PRS), which is available commercially from Pilot Chemical Company of Santa Fe Springs, Calif.

Mixture 2

| Ingredients | Volume Fraction |
|---|---|
| Lacolene | 0.135 |
| Oxol 100 | 0.23 |
| Dow Corning OS-10 | 0.315 |
| Acetone | 0.32 |
| Net | 1 |

Dow Corning OS-10 consists of greater than 60 percent hexamethyldisiloxane (HMDS), which is a linear, volatile, completely methylated siloxane.

Mixture 3

| Ingredients | Volume Fraction |
|---|---|
| d-Limonene | 0.08 |
| Oxol 100 | 0.23 |
| Solvent 142 | 0.035 |
| SF 1202 | 0.38 |
| PRS | 0.1 |
| MOL | 0.0515 |
| Deionized water | 0.1235 |
| Net | 1 |

SF 1202 (CAS Number: 541-02-6) consists of greater than 90 percent decamethylcyclopentasiloxane.

Mixture 4

| Ingredients | Volume Fraction |
|---|---|
| d-Limonene | 0.08 |
| Oxol 100 | 0.22 |
| MOL | 0.16 |
| PRS | 0.003 |
| Dow Corning 244 fluid | 0.507 |
| Solvent 142 | 0.03 |
| Net | 1 |

Dow Corning 244 fluid consists of greater than 60 percent octamethylcyclotetrasiloxane Mixture 5

| Ingredients | Volume Fraction |
|---|---|
| d-Limonene | 0.08 |
| Oxol 100 | 0.22 |
| MOL | 0.16 |
| Calimulse PRS | 0.014 |
| SMO | 0.05 |
| Dow Corning 244 fluid | 0.319 |
| Solvent 142 | 0.157 |

Mixture 6

| Ingredients | Volume Fraction |
|---|---|
| d-Limonene | 0.16 |
| Oxol 100 | 0.46 |
| Solvent 142 | 0.065 |

-continued

| Mixture 6 | |
|---|---|
| Ingredients | Volume Fraction |
| PRS | 0.014 |
| SMO | 0.05 |
| MOL | 0.251 |
| Net | 1 |

Example 2

Emulsion Preparation

A mixture of various components, such as any of Mixtures 1-6 set forth in Example 1, and water, are placed in a mixer, such as Schold Mixer. The mixture is mixed at a rate of between 600-3600 rpm for 24 hours. The emulsion is obtained as a milky white liquid.

Stability tests show that the emulsion obtained by these methods remains stable, i.e., does not separate, for a period of at least two months.

What is claimed is:

1. An emulsified composition for cleaning printing machines, the composition comprising:

a hydrocarbon solvent, wherein the hydrocarbon solvent is selected from the group consisting of limonene, paraffins, and a combination thereof, wherein the hydrocarbon is present in between 11 to 50% by volume;

an aromatic solvent, wherein the aromatic solvent is 1-chloro-4-(trifluoromethyl) benzene, wherein the aromatic solvent is present in between 22 to 46% by volume;

a methylated siloxane, wherein the methylated siloxane is selected from the group consisting of decamethylcyclopentasiloxane, dodecamethyl cyclohexasiloxane, and octamethylcyclotetrasiloxane, wherein the methylated siloxane is present in between 31.5 to 75% by volume; and a surfactant, wherein the surfactant is selected from the group consisting of isopropylamine linear dodecylbenzene sulfonate, sorbitan monooleate, methyl oleate, and a combination thereof, wherein the surfactant is present in between 15.2% and 75% by volume;

wherein the composition is an emulsion.

2. The composition of claim 1, wherein the hydrocarbon solvent is a combination of limonene and paraffins.

3. The composition of claim 1, further comprising water.

4. The composition of claim 1, wherein the surfactant is isopropylamine linear dodecylbenzene sulfonate.

5. The composition of claim 1, wherein the surfactant methyl oleate.

6. The composition of claim 1, wherein the surfactant is sorbitan monooleate.

7. The composition of claim 1, wherein the surfactant is a mixture of isopropylamine linear dodecylbenzene sulfonate, sorbitan monooleate, and methyl oleate.

8. The composition of claim 1, wherein the surfactant is a mixture of isopropylamine linear dodecylbenzene sulfonate and sorbitan monooleate.

9. The composition of claim 1, wherein the composition comprises less than 35% by volume of the hydrocarbon solvent.

10. The composition of claim 1, wherein the composition comprises less than 30% by volume of the aromatic solvent.

11. The composition of claim 1, wherein the composition comprises less than 50% by volume of the methylated siloxane.

12. The composition of claim 1, wherein the composition comprises less than 20% by volume of the surfactant.

* * * * *